US008938969B2

(12) United States Patent
Yuasa et al.

(10) Patent No.: US 8,938,969 B2
(45) Date of Patent: Jan. 27, 2015

(54) COMBUSTOR AND ROTATING MACHINE

(71) Applicant: Mitsubishi Heavy Industries, Ltd., Tokyo (JP)

(72) Inventors: Atsushi Yuasa, Tokyo (JP); Toshihiko Saito, Tokyo (JP); Kotaro Miyauchi, Tokyo (JP); Keijiro Saito, Tokyo (JP); Satoshi Takiguchi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 14/161,120

(22) Filed: Jan. 22, 2014

(65) Prior Publication Data

US 2014/0202161 A1 Jul. 24, 2014

(30) Foreign Application Priority Data

Jan. 22, 2013 (JP) ..... 2013-009204
Jan. 21, 2014 (JP) ..... 2014-008390

(51) Int. Cl.

| | |
|---|---|
| ***F02C 1/00*** | (2006.01) |
| ***F23R 3/34*** | (2006.01) |
| ***F23R 3/54*** | (2006.01) |
| ***F23R 3/14*** | (2006.01) |
| ***F23R 3/60*** | (2006.01) |

(52) U.S. Cl.

CPC . *F23R 3/343* (2013.01); *F23R 3/54* (2013.01); *F23R 3/14* (2013.01); *F23R 3/60* (2013.01)

USPC ..... 60/740

(58) Field of Classification Search

CPC ..... F23R 3/14; F23R 3/343; F23R 3/54; F23R 3/60

USPC ..... 60/39.37, 737, 740, 742, 746, 748

See application file for complete search history.

(56) References Cited

U.S. PATENT DOCUMENTS

| | | | | |
|---|---|---|---|---|
| 5,319,935 | A * | 6/1994 | Toon et al. | 60/733 |
| 5,660,044 | A * | 8/1997 | Bonciani et al. | 60/737 |
| 6,026,645 | A * | 2/2000 | Stokes et al. | 60/737 |
| 6,038,861 | A * | 3/2000 | Amos et al. | 60/737 |
| 7,600,370 | B2 * | 10/2009 | Dawson | 60/39.37 |
| 7,788,926 | B2 * | 9/2010 | Johnson et al. | 60/725 |
| 8,336,312 | B2 * | 12/2012 | Rajaram et al. | 60/725 |
| 2001/0020364 | A1 * | 9/2001 | Sato et al. | 60/746 |
| 2004/0055306 | A1 * | 3/2004 | North et al. | 60/737 |
| 2010/0275605 | A1 * | 11/2010 | Hase et al. | 60/748 |
| 2011/0265482 | A1 | 11/2011 | Parsania et al. | |
| 2011/0296839 | A1 * | 12/2011 | Van Nieuwenhuizen et al. | 60/737 |
| 2012/0017595 | A1 | 1/2012 | Liu | |
| 2012/0111012 | A1 * | 5/2012 | Axelsson et al. | 60/737 |

FOREIGN PATENT DOCUMENTS

| | | | |
|---|---|---|---|
| JP | 06-129640 | A | 5/1994 |
| JP | 2007-232347 | A | 9/2007 |
| JP | 2011-232023 | A | 11/2011 |

* cited by examiner

*Primary Examiner* — Phutthiwat Wongwian

(74) *Attorney, Agent, or Firm* — Westerman, Hattori, Daniels & Adrian, LLP

(57) ABSTRACT

A combustor includes: a combustor basket configured to surround a fuel nozzle from an outer circumferential side, and a plurality of connecting members formed in a circumferential direction at intervals to connect a rear end of the combustor basket and a casing and configured to define a flow path through which compressed air introduced into the combustor basket flows. A circulation direction of the compressed air flowing through the flow path is configured to be reversed at a rear end of the combustor basket and the compressed air is introduced into the fuel nozzle. The flow path is partially or entirely inclined in the circumferential direction to blow the compressed air.

9 Claims, 9 Drawing Sheets

COMBUSTOR AND ROTATING MACHINE

TECHNICAL FIELD

The present invention relates to a combustor including a fuel nozzle, and a rotating machine.

Priority is claimed on Japanese Patent Application No. 2013-009204, filed Jan. 22, 2013, and Japanese Patent Application No. 2014-008390, filed Jan. 21, 2014, the contents of which are incorporated herein by reference.

BACKGROUND ART

A combustor of a gas turbine serving as a rotating machine generally includes a combustor basket connected to a fuel gas inlet of the turbine and configured to combust the supplied fuel and supply the generated combustion gas to the turbine, a pilot nozzle disposed at a center of the combustor basket and configured to inject the fuel into the combustor basket to form a flame for stabilizing a pre-mixed flame of a main nozzle, and a plurality of main nozzles disposed around the pilot nozzle and configured to inject pre-mixed air of the compressed air and the fuel into the combustor basket and ignite the fuel to form the pre-mixed flame.

The combustor basket is fixed to a casing by a plurality of ribs parallel to an air flow introduced into the combustor (for example, see Patent Literature 1). The ribs function as a structural member and are configured not to exert an influence on the air flow.

CITATION LIST

Patent Literature

[Patent Literature 1] Japanese Unexamined Patent Application, First Publication No. 2007-232347

SUMMARY OF INVENTION

Technical Problem

Here, while the plurality of ribs configured to fix the combustor basket are merely structural members and the number and shape of the ribs are set to exert as little influence on a flow of the compressed air as possible, uniformity of the pre-mixed air may be decreased by turbulence of the compressed air generated by the ribs.

An object of the present invention is to provide a combustor capable of forming more uniform pre-mixed air.

Solution to Problem

According to a first aspect of the present invention, a combustor includes: a fuel nozzle; a combustor basket configured to surround the fuel nozzle from an outer circumferential side; and a plurality of connecting members installed in the circumferential direction at intervals to connect a rear end of the combustor basket and a casing, and configured to define a flow path through which compressed air introduced into the combustor basket flows. A circulation direction of the compressed air flowing through the flow path is configured to be reversed at a rear end of the combustor basket and the compressed air is introduced into the fuel nozzle. The flow path is partially or entirely inclined in the circumferential direction to blow the compressed air.

According to the above-mentioned configuration, since a flow of the compressed air after passing the connecting member is inclined and a swirl is applied to the flow, mixing of the fuel and the compressed air is promoted and more uniform pre-mixed air can be formed.

In addition, as the swirl is applied to the flow of the compressed air, loss of a wake (a trailing vortex) generated by the connecting member can be promoted. Accordingly, turbulence of the compressed air flow by the connecting member can be suppressed, and formation of the uniform pre-mixed air can be promoted.

In the combustor, the fuel nozzle may include: a pilot nozzle extending along an axis; and a plurality of main nozzles disposed in a circumferential direction of the axis at intervals and configured to inject fuel from at least one thereof, wherein the compressed air is introduced into the main nozzle.

In the combustor, the connecting member may be a plate-shaped member. An extending direction of the connecting member may form a predetermined angle with respect to a radial direction of the axis.

According to the above-mentioned configuration, since the connecting member, which is a component of the related art, can be used, it is not necessary to add of a new component configured to apply the swirl to the compressed air.

In the combustor, a configuration having a fuel path formed in the connecting member and a fuel injection hole formed in a surface of the connecting member and configured to inject fuel from the fuel path may be provided.

According to the above-mentioned configuration, as the fuel is injected from an upstream side of the fuel nozzle, concentration distribution of the fuel can be improved. In addition, as the fuel is injected to a place at which the swirl is applied by the connecting member, the fuel and the compressed air can be easily mixed.

In the combustor, the plurality of fuel injection holes may be formed in the axial direction.

According to the above-mentioned configuration, a retention time until the fuel arrives at a flame front can be varied, and optimal fuel concentration distribution in which combustion vibration is suppressed can be formed. That is, as a time delay until the fuel is combusted can be adjusted, and a structure configured to contribute to suppression of the combustion vibration can be provided.

In the combustor, the connecting member may be formed to be curved at a connecting section of the casing.

According to the above-mentioned configuration, the swirl can be more securely applied to the flow of the compressed air after passing the connecting member.

In addition, the present invention provides a rotating machine including any one of the combustors.

Advantageous Effects of Invention

According to the present invention, as the flow of the compressed air after passing the connecting member is inclined, mixing of the fuel and the compressed air is promoted, and thus, more uniform pre-mixed air can be formed.

EMBODIMENTS OF INVENTION

First Embodiment

Hereinafter, a first embodiment of the present invention will be described in detail with reference to the accompanying drawings.

Figure 1:
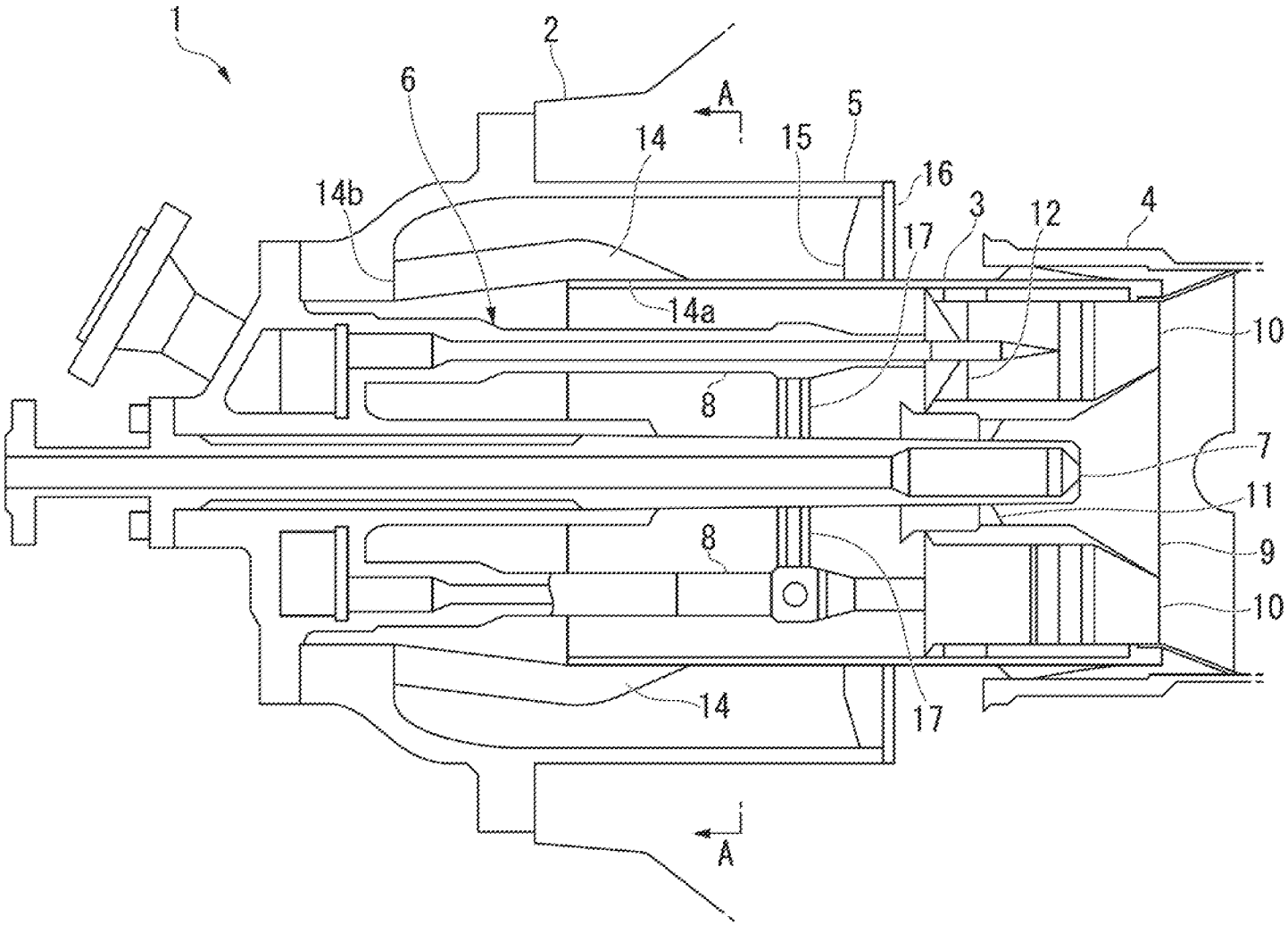
FIG. 1 is a cross-sectional view showing a configuration of the inside of a combustor basket of a combustor of a first embodiment of the present invention.

As shown in FIG. 1, a gas turbine combustor 1 (hereinafter, simply referred to as a combustor) of a gas turbine (a rotating machine) of the embodiment includes a combustor basket 3 accommodated in a casing 2, a transition piece 4 fitted into the combustor basket 3, and an outer shell 5 configured to cover an outer circumferential side of the combustor basket 3 and abut an inner wall of the casing 2. The transition piece 4 is a tubular hollow member. The combustor basket 3 is also a tubular hollow member, and an outer diameter thereof is slightly smaller than an inner diameter of the transition piece 4.

In addition, the combustor 1 includes a fuel nozzle 6 constituted by a pilot nozzle 7 and a main nozzle 8, a pilot cone 9 installed to cover a tip side of the pilot nozzle 7, a main burner 10 installed to cover a tip side of the main nozzle 8, a pilot swirler 11 installed between an outer wall of the pilot nozzle 7 and an inner wall of the pilot cone 9, and a main swirler 12 installed between an outer wall of the main nozzle 8 and an inner wall of the main burner 10.

The pilot nozzle 7 is a nozzle disposed at a center of the combustor 1 and configured to perform diffusion combustion. The main nozzle 8 is a plurality of nozzles disposed in a circumferential direction of an outer circumferential side of the pilot nozzle 7 at equal intervals and configured to perform pre-mixing combustion.

In addition, a plurality of first ribs 14 (connecting members) connected to a more outer circumference of the combustor basket 3 on the other side (a left side of FIG. 1) in an axial direction of the combustor basket 3 (hereinafter, simply referred to as an axial direction) are formed at the combustor 1. In addition, a second rib 15 configured to support a punching metal 16 constituted by a porous plate installed at an inlet portion of a space between the outer shell 5 and the combustor basket 3 of one side in the axial direction is formed at the combustor 1. As the first rib 14 and the second rib 15 are connected to the outer shell 5 and the combustor basket 3, the combustor basket 3 is supported by the outer shell 5 and is fixed to the outer shell 5. Further, as a support rod 17 configured to connect the outer circumferential surface of the pilot nozzle 7 and the main nozzle 8 is installed at a downstream side of the pilot nozzle 7, the main nozzle 8 is fixed.

The first rib 14 is a plate-shaped member having a length in the axial direction of the combustor basket 3, and a side surface 14*a* of one side (a right side of FIG. 1) in the axial direction is connected to the outer circumferential surface of the combustor basket 3. In addition, the other end section 14*b* in the axial direction is connected to the outer shell 5.

Figure 2:
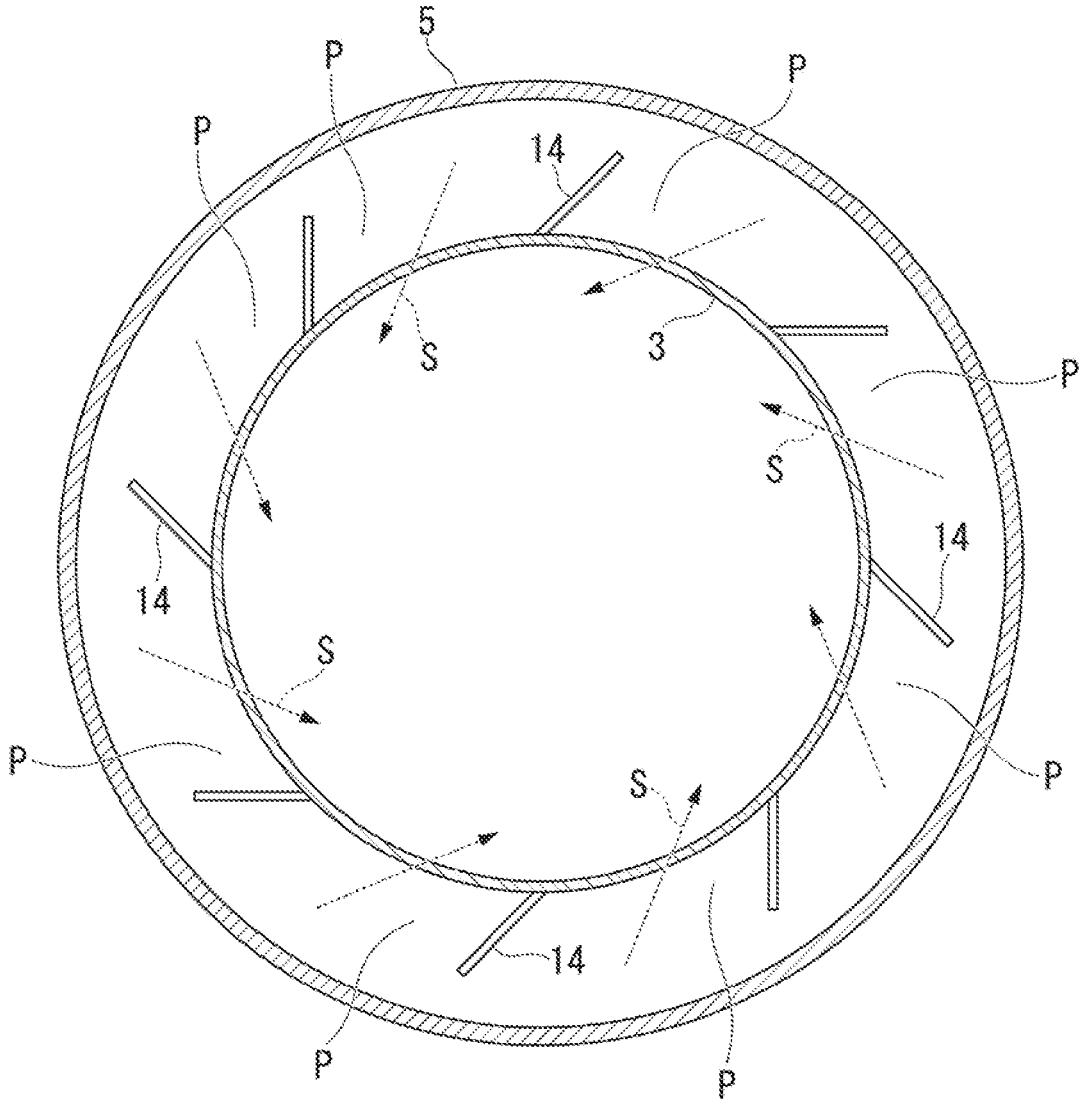
FIG. 2 is a cross-sectional view taken along line A-A in FIG. 1.

Then, as shown in FIG. 2, the first rib 14 is angularly fixed with respect to a flow direction of the compressed air. Specifically, the first rib 14 is disposed such that a longitudinal direction (leftward and rightward directions of FIG. 1) thereof is disposed in the axial direction of the combustor basket 3, and is fixed to be inclined in the circumferential direction as a short-length direction (also referred to as a height direction) is disposed toward the inside or the outside in the radial direction of the combustor basket 3. That is, the first rib 14 is connected such that an extending direction of the first rib 14 has a predetermined angle with respect to the radial direction of the axis of the combustor basket 3 without being perpendicularly connected to the outer circumferential surface of the combustor basket 3 and the first rib 14 at a connecting section of the combustor basket 3. In other words, the first rib 14 is configured such that a flow path P formed by the first rib 14 is inclined toward the circumferential direction.

Further, while the first rib 14 is configured such that the flow path P defined by the first rib 14 is inclined in the circumferential direction throughout the flow direction of the compressed air, a portion of the flow path P, rather than the entire flow path P, may be formed to be inclined in the circumferential direction.

In the combustor 1 having the above-mentioned configuration, the compressed air discharged from the outlet of the compressor (not shown) into the casing 2 flows into a space between the outer shell 5 and the combustor basket 3 through the punching metal 16. The punching metal 16 is formed into a porous plate to apply resistance and thus functions to rectify the compressed air flowing into the combustor 1. The compressed air flowing into the space between the outer shell 5 and the combustor basket 3 through the punching metal 16 flows along the inner wall of the outer shell 5.

Then, as the compressed air is turned 180° at a bottom portion of the outer shell 5 (a base portion of the fuel nozzle 6 constituted by the pilot nozzle 7 and the main nozzle 8), the compressed air flows between the first ribs 14 configured to support the combustor basket 3 to be supplied into the combustor basket 3. Then, finally, a rotational flow is provided to the pilot swirler 11 and the main swirler 12 of the combustor 1 and used in the fuel nozzle 6. That is, the compressed air is used in the diffusion combustion by the pilot nozzle 7 and the pre-mixing combustion by the main nozzle 8.

Here, as the first rib is angularly fixed with respect to the flow direction of the compressed air, as represented by reference character S in FIG. 2, a swirl (a rotational flow) is provided to the flow of the compressed air turned at 180°. That is, the swirl is applied to the flow of the compressed air after passing the first rib 14, and the flow of the compressed air is a spiral flow with an angle.

According to the embodiment, as the swirl is applied to the flow of the compressed air after passing the first rib 14, mixing of the fuel and the compressed air is promoted, and more uniform pre-mixed air can be formed.

In addition, as the swirl is applied to the flow of the compressed air, loss of a wake (a trailing vortex) generated by the first rib 14 can be promoted. Accordingly, turbulence of the compressed air flow by the first rib 14 can be suppressed, and formation of the uniform pre-mixed air can be promoted.

In addition, since the first rib 14, which is the component of the related art, can be used, addition of a new component configured to apply the swirl to the compressed air is not needed.

Next, a modified example of the first rib 14 will be described.

Figure 3:
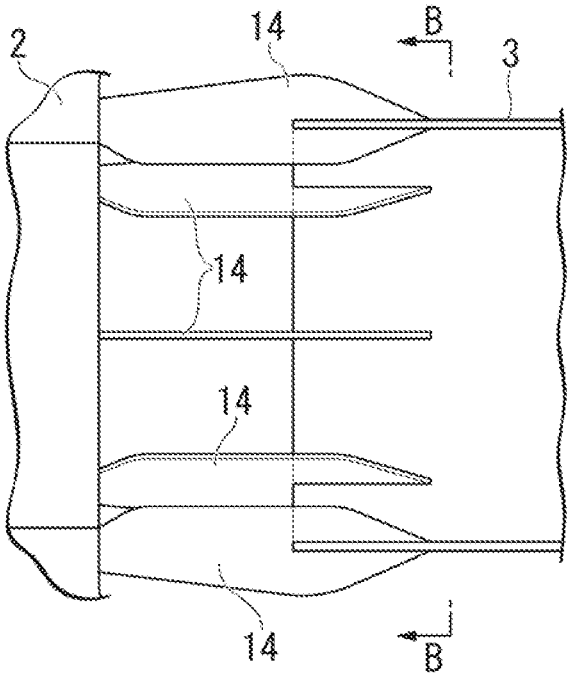
FIG. 3 is a cross-sectional view showing a modified example of a first rib of the first embodiment of the present invention.
Figure 4:
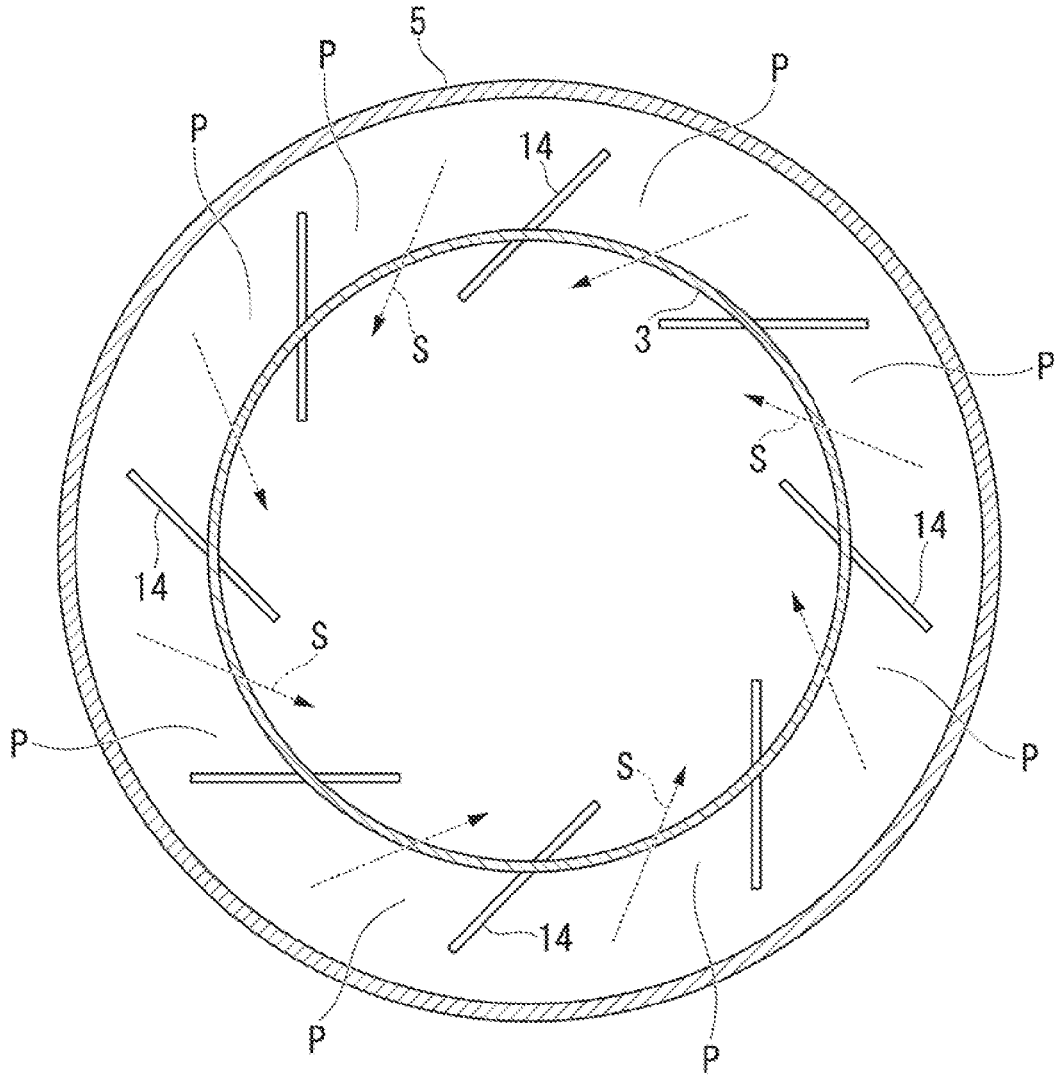
FIG. 4 is a cross-sectional view taken along line B-B in FIG. 3.

As shown in FIGS. 3 and 4, the first rib 14 of the modified example is longer in a short-length direction and a shape thereof extends toward an inner circumferential side (a central side in the radial direction) of the combustor basket 3.

According to the above-mentioned shape, strong rotation can be applied by the compressed air.

Second Embodiment

Figure 5:
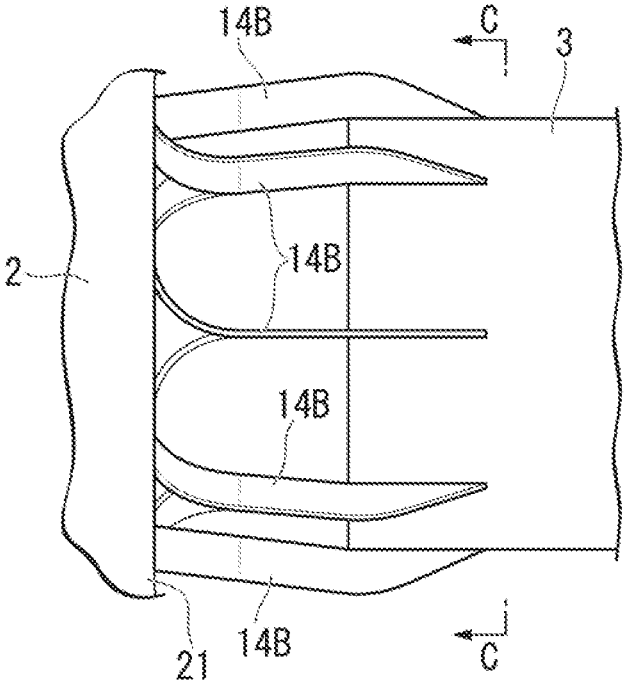
FIG. 5 is a side view showing a first rib of a combustor of a second embodiment of the present invention.
Figure 6:
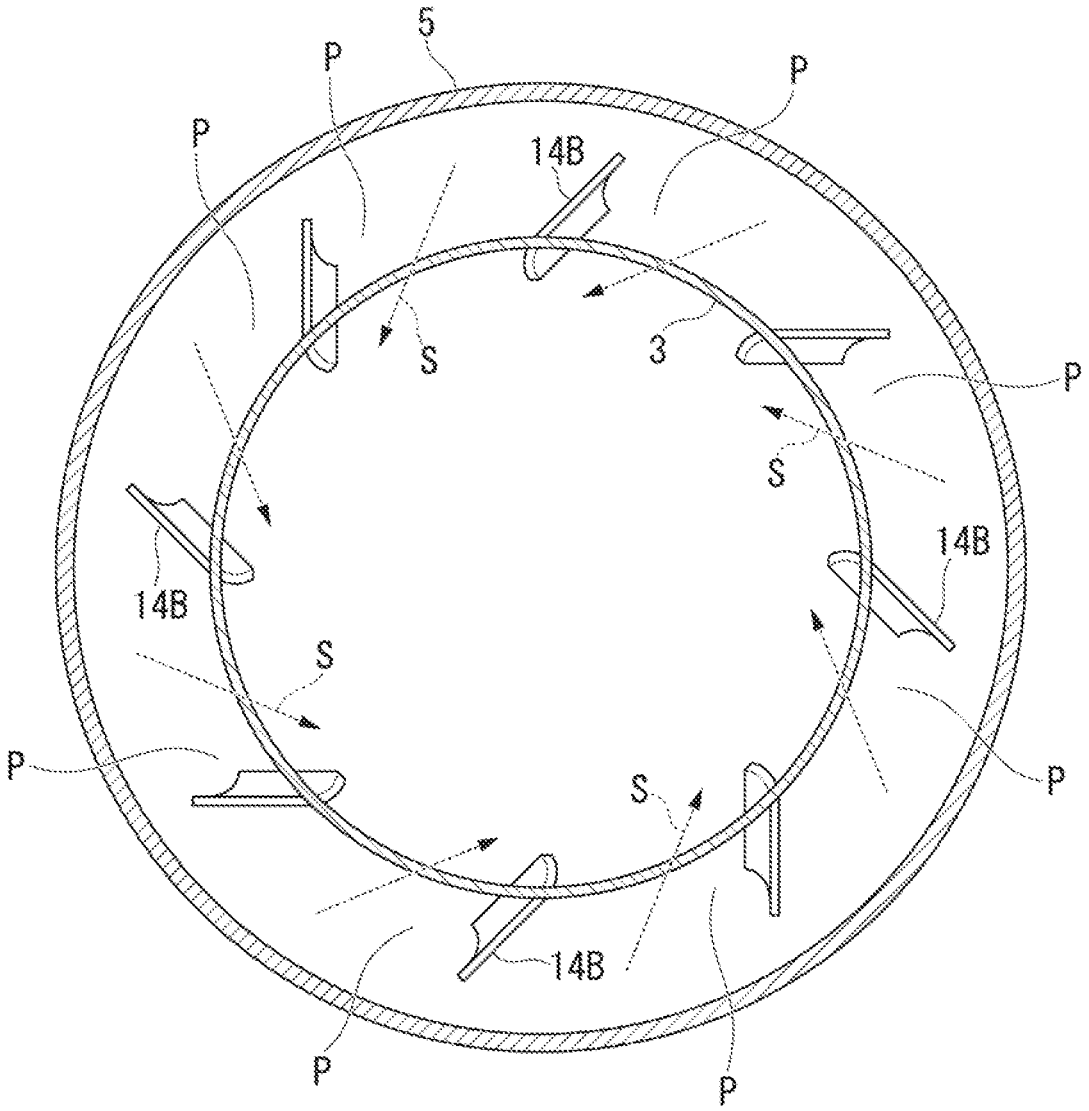
FIG. 6 is a cross-sectional view taken along line C-C in FIG. 4.

FIGS. 5 and 6 are views showing a first rib 14B of a combustor 1 of a second embodiment of the present invention. Further, description of the embodiment will focus on points different from the above-mentioned first embodiment, with description of like portions omitted.

The first rib 14B of the embodiment is the other side (a left side of FIG. 5) in the longitudinal direction, and a side thereof connected to the outer shell 5 has a curved shape. Specifically, the first rib 14B is inclined in the circumferential direction as it moves toward the inside of the outside in the radial direction, and is curved such that the swirl is curved near a partition plate section 21 in the circumferential direction and applied upon U turn in the axial direction of compressed air as it moves toward the other side (a left side of FIG. 5) in the axial direction.

The first rib 14B of the embodiment may be connected to a connecting section of the combustor basket 3 such that the outer circumferential surface of the combustor basket 3 and the first rib 14B are perpendicular to each other or form a certain angle. In addition, a bending start position, a bending angle, a bending direction, and so on, of the bending of the first rib 14B are appropriately determined by fluid analysis or the like using a computer.

According to the embodiment, the swirl can be more securely applied to the flow of the compressed air after passing the first rib 14B.

Third Embodiment

Figure 7:
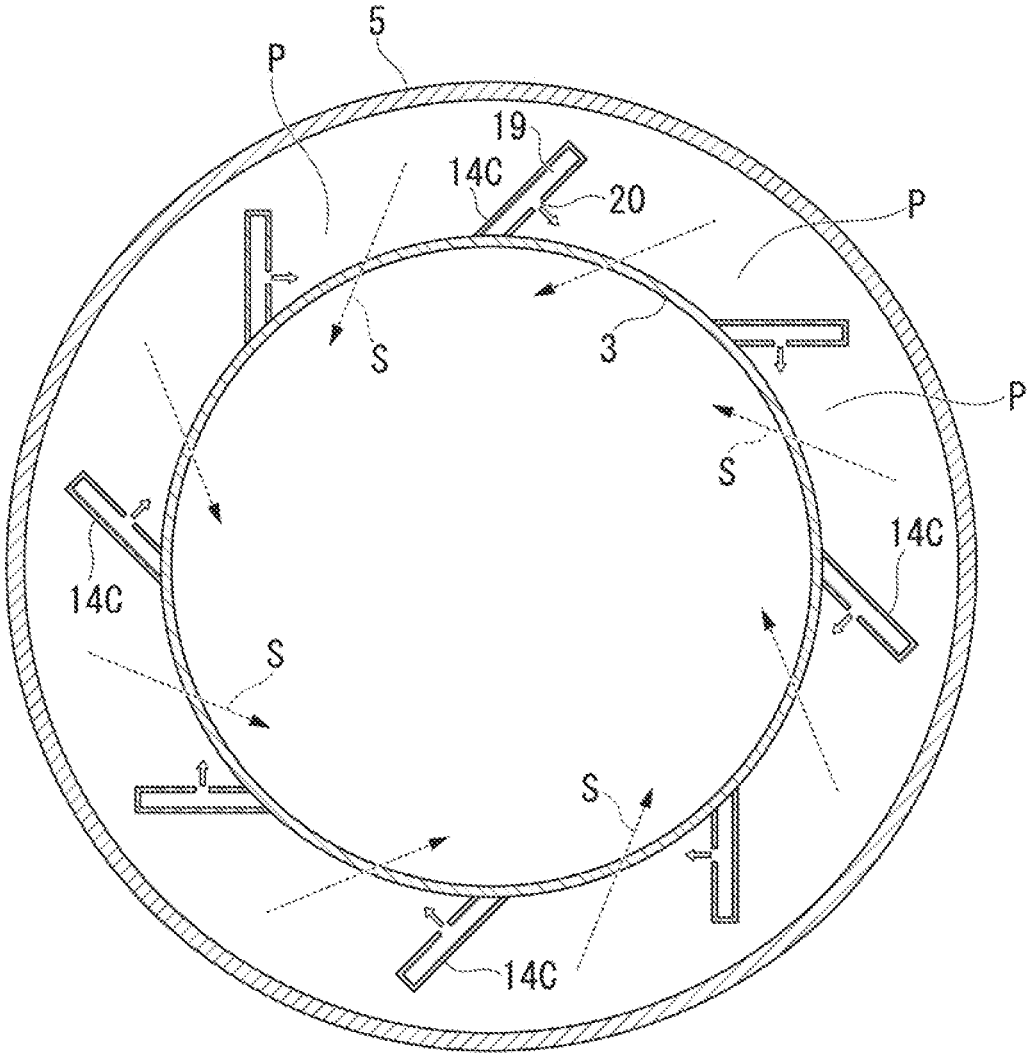
FIG. 7 is a cross-sectional view showing a first rib of a combustor of a third embodiment of the present invention, corresponding to FIG. 2.

FIG. 7 is a cross-sectional view showing a first rib 14C of a combustor 1 according to a third embodiment of the present invention, corresponding to FIG. 2. Further, description of the embodiment will focus on points different from the above-mentioned first embodiment, with description of like portions omitted.

As the first rib 14C of the embodiment has a hollow structure, a fuel path 19 is formed in the first rib 14C. In addition, a fuel injection hole 20 is formed at a surface facing the outer circumferential surface of the combustor basket 3 (a surface facing the inside in the radial direction of the combustor basket 3), which is one surface of the first rib 14C, and the fuel supplied into the fuel path 19 can be injected from the fuel injection hole 20.

According to the embodiment, as the fuel is injected from an upstream side of the fuel nozzle 6 (the main nozzle 8), concentration distribution of the fuel can be improved. Further, as an angle of the first rib 14C with respect to the combustor basket 3 and disposition of the fuel injection hole 20 are adjusted, arbitrary fuel concentration distribution can be formed in the radial direction of the combustor 1.

In addition, as the fuel is injected to a place at which the swirl is applied by the first rib 14C, the fuel and the compressed air are easily mixed.

Further, the plurality of fuel injection holes 20 may be formed to vary positions in the height direction (the short-length direction) of the first rib 14C. In addition, the holes are not limited to only one surface of the first rib 14C but may be formed at both surfaces. That is, the fuel injection hole 20 may be formed at the other surface side facing the outer shell 5 (a surface facing the outside in the radial direction of the combustor basket 3) and the fuel may be injected from both sides in the circumferential direction of the compressed air flowing through the flow path P.

In addition, the fuel injection holes 20 need not be formed at the entire first rib 14C but may be formed at appropriate places according to the analysis result.

Fourth Embodiment

Figure 8:
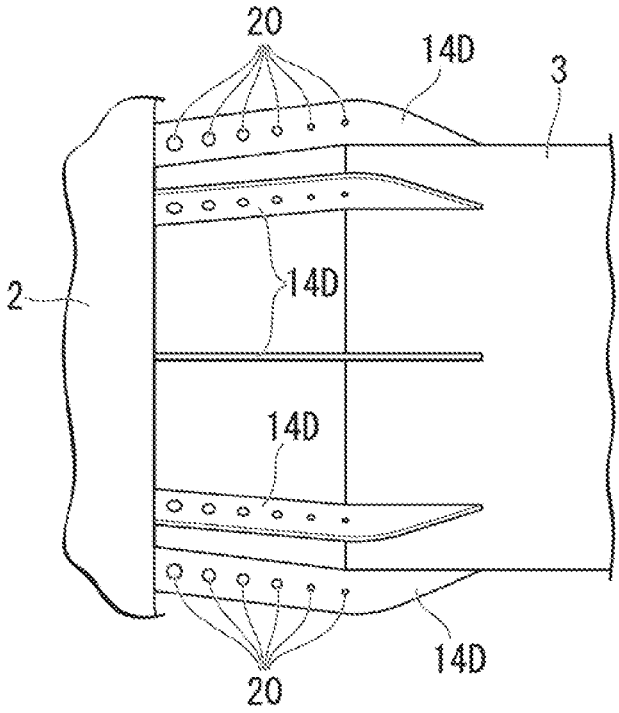
FIG. 8 is a cross-sectional view showing a first rib of a combustor of a fourth embodiment of the present invention, corresponding to FIG. 3.

FIG. 8 is a cross-sectional view showing a first rib 14D of a combustor 1 of a fourth embodiment of the present invention. Further, description of the embodiment will focus on points different from the above-mentioned first embodiment, with description of like portions omitted.

In the first rib 14D of the embodiment, the plurality of fuel injection holes 20 (in the embodiment, six holes) are arranged in a longitudinal direction thereof. The fuel injection hole 20 is formed to have a diameter reduced from the other side (an upstream side) in the axial direction toward one side (a downstream side) in the axial direction. In other words, the fuel injection hole 20 is formed to have a diameter reduced toward the main nozzle 8.

According to the embodiment, as a retention time until the fuel arrives at a flame front can be varied, optimal fuel concentration distribution in which combustion vibrations are suppressed can be formed. That is, a time delay until the fuel is combusted can be adjusted, and thus a structure configured to contribute to suppression of the combustion vibration can be provided.

Figure 9:
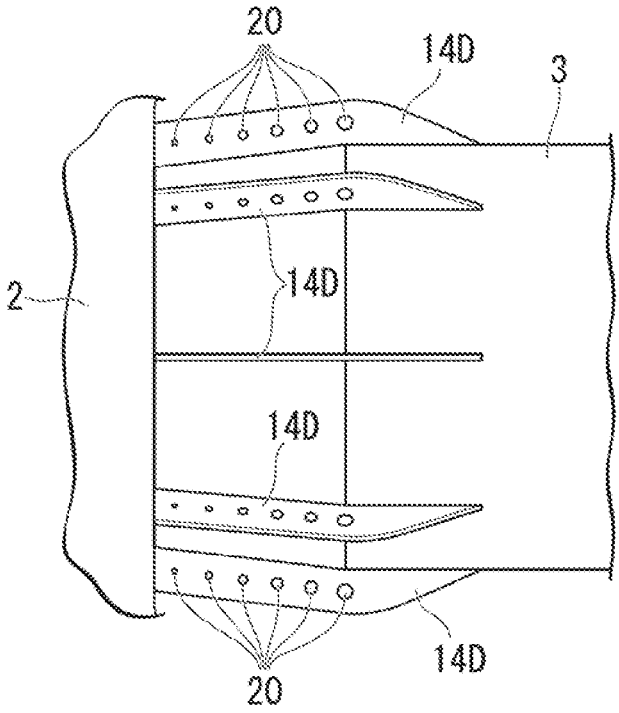
FIG. 9 is a cross-sectional view showing a modified example of the first rib of the fourth embodiment of the present invention.

In addition, as shown in FIG. 8, the retention time becomes longer when the diameter of the upstream side is increased, and as shown in FIG. 9, the retention time becomes shorter when the diameter of the downstream side is decreased. On the other hand, as the distribution of the diameter is varied in this way, gradation of the fuel concentration supplied toward the main nozzle 8 can be simultaneously adjusted.

In addition, while not shown, the plurality of fuel injection holes 20 may have a uniform size. As the plurality of fuel injection holes 20 have the uniform size, uniformity of the pre-mixed air immediately after supply of the fuel injected from the fuel injection hole 20 can be increased.

Figure 10:
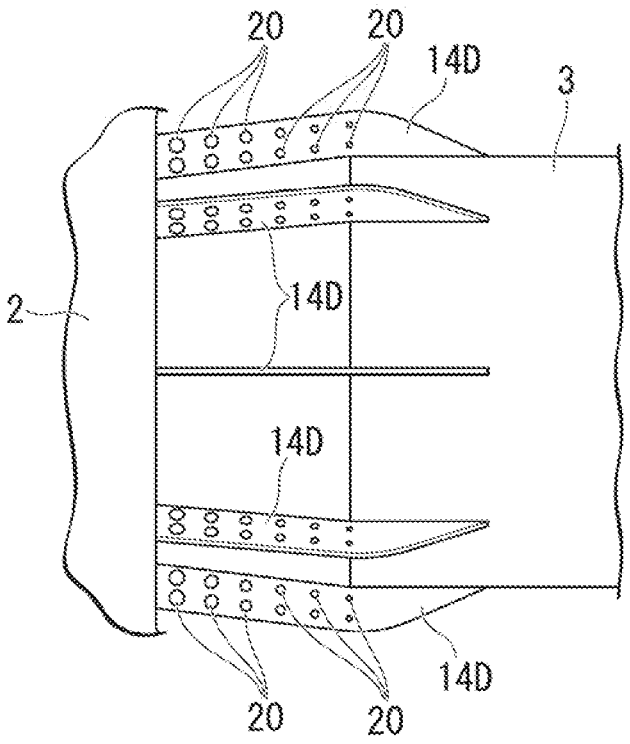
FIG. 10 is a cross-sectional view showing a modified example of the first rib of the fourth embodiment of the present invention.

In addition, as shown in FIG. 10, the plurality of fuel injection holes 20 may be formed in a plurality of rows in the height direction of the first rib 14D. In addition, the fuel injection holes 20 may be formed at both surfaces of the first rib 14D.

Further, the technical scope of the present invention is not limited to the above-mentioned embodiments but various modifications may be applied to the above-mentioned embodiments without departing from the spirit of the present invention. That is, the configurations or the like described in the above-mentioned embodiments are exemplary configurations and may be appropriately modified.

For example, the first rib 14 may have a cross-sectional shape formed in a wing shape. That is, the first rib 14 may have an optimal cross-sectional shape to appropriately apply the swirl to the rotating compressed air.

REFERENCE SIGNS LIST

1 combustor
2 casing
3 combustor basket
4 transition piece
5 outer shell
6 fuel nozzle
7 pilot nozzle
8 main nozzle
9 pilot cone
10 main burner
11 pilot swirler
12 main swirler
14 first rib (connecting member)
14*a* side surface
14*b* other end section
15 second rib
16 punching metal
17 support rod
19 fuel path
20 fuel injection hole

The invention claimed is:

1. A combustor comprising:

a fuel nozzle comprising a pilot nozzle extending along an axis, and a plurality of main nozzles disposed in a circumferential direction of the axis at intervals and configured to inject fuel from at least one thereof;

a combustor basket configured to surround the fuel nozzle from an outer circumferential side; and a plurality of connecting members provided on an upstream side of the axis with respect to the main nozzles, disposed such that a longitudinal direction of the connecting members is disposed in the axial direction of the combustor basket, and is fixed to be inclined in the circumferential direction as a short-length direction of the connecting members is disposed toward the outside in the radial direction of the combustor basket, installed in the circumferential direction at intervals to connect the rear end of the combustor basket and a casing, and configured to define a flow path through which compressed air introduced into the combustor basket flows, wherein the connecting member is formed with a fuel path, wherein a fuel injection hole is formed in a surface of the connecting member and is configured to inject fuel from the fuel path, wherein a circulation direction of the compressed air flowing through the flow path is configured to be reversed at a rear end of the combustor basket, and the compressed air is introduced into the main nozzles, and wherein the flow path is partially or entirely inclined in the circumferential direction to blow the compressed air.

2. The combustor according to claim 1, wherein the connecting member is a plate-shaped member, and an extending direction of the connecting member forms a predetermined angle with respect to a radial direction of the axis.

3. The combustor according to claim 1, wherein the plurality of fuel injection holes are formed in the axial direction.

4. The combustor according to claim 2, wherein the plurality of fuel injection holes are formed in the axial direction.

5. The combustor according to claim 1, wherein the connecting member is formed to be curved at a connecting section of the casing.

6. The combustor according to claim 2, wherein the connecting member is formed to be curved at a connecting section of the casing.

7. The combustor according to claim 3, wherein the connecting member is formed to be curved at a connecting section of the casing.

8. The combustor according to claim 4, wherein the connecting member is formed to be curved at a connecting section of the casing.

9. A rotating machine comprising the combustor according to claim 1.

* * * * *